US012655640B2

(12) United States Patent
Sato

(10) Patent No.: US 12,655,640 B2
(45) Date of Patent: Jun. 16, 2026

(54) WALL PANEL UNIT AND METHOD FOR INSTALLING WALL PANEL UNIT

(71) Applicant: Susumu Sato, Tokyo (JP)

(72) Inventor: Susumu Sato, Tokyo (JP)

(73) Assignee: Susumu Sato, Tokyo (JP)

( * ) Notice: Subject to any disclaimer, the term of this patent is extended or adjusted under 35 U.S.C. 154(b) by 171 days.

(21) Appl. No.: 18/569,382

(22) PCT Filed: Jun. 14, 2022

(86) PCT No.: PCT/JP2022/023816
§ 371 (c)(1),
(2) Date: Dec. 12, 2023

(87) PCT Pub. No.: WO2022/265015
PCT Pub. Date: Dec. 22, 2022

(65) Prior Publication Data

US 2024/0254774 A1 Aug. 1, 2024

(30) Foreign Application Priority Data

Jun. 15, 2021 (WO) ..... PCT/JP2021/022720

(51) Int. Cl.
*E04F 13/08* (2006.01)

(52) U.S. Cl.
CPC ..... *E04F 13/081* (2013.01)

(58) Field of Classification Search
CPC .... E04F 13/081; E04F 13/083; E04F 13/0851
See application file for complete search history.

(56) References Cited

U.S. PATENT DOCUMENTS 5,065,557 A * 11/1991 Laplante ..... E04B 2/96 52/510
6,226,947 B1 * 5/2001 Bado ..... E04F 13/0816 52/479

(Continued)

FOREIGN PATENT DOCUMENTS

DE 19803150 A1 * 7/1999 ..... E04F 13/083
DE 202007006381 U1 7/2007

(Continued)

OTHER PUBLICATIONS

International Search Report (ISR) dated Aug. 23, 2022 filed in PCT/JP2022/023816.

(Continued)

*Primary Examiner* — Theodore V Adamos
(74) *Attorney, Agent, or Firm* — RANKIN, HILL & CLARK LLP

(57) ABSTRACT

An object to be solved by the present invention is to provide a wall panel unit applicable to various wall panels. In addition, another object of the present invention is to provide a wall panel unit which allows a wall panel to be installed more easily. The present invention is a wall panel unit 100, 200, 300, 400, 500 including a fixing body 20 provided between a wall surface W and a panel body 10 and capable of fixing the panel body 10 to the wall surface W, the fixing body 20 including a first fixing body 21 fixed to the panel body 10 and a second fixing body 22 fixed to the wall surface W and connected to the first fixing body 21.

10 Claims, 19 Drawing Sheets

(56) References Cited

U.S. PATENT DOCUMENTS 6,286,802 B1 * 9/2001 Munson ..... A47G 1/1606 248/475.1
8,359,811 B2 * 1/2013 Muller ..... E04F 13/0819 52/510
10,697,183 B1 * 6/2020 Ferguson ..... E04B 1/34321
10,753,090 B2 * 8/2020 Gulnick ..... E04B 9/04
10,876,299 B2 * 12/2020 Dye ..... E04F 13/083
2003/0038222 A1 * 2/2003 Holmes ..... A47G 1/1606 248/490
2005/0006554 A1 * 1/2005 DeLine ..... A47G 1/1633 248/475.1
2005/0072894 A1 * 4/2005 Grant ..... A47B 95/008 248/475.1
2007/0022683 A1 * 2/2007 McGee ..... E04F 13/0805 52/270
2009/0313935 A1 * 12/2009 Montgomery ..... E04F 13/083 428/522
2011/0260129 A1 * 10/2011 Schopf ..... F16B 2/06 248/316.1
2012/0151861 A1 * 6/2012 Mulhair ..... E04F 13/083 52/745.1
2012/0304573 A1 * 12/2012 Aboukhalil ..... E04F 19/061 52/506.05
2013/0048812 A1 * 2/2013 Lozano ..... H05K 5/0204 248/220.22
2014/0150614 A1 * 6/2014 Aboukhalil ..... E04F 13/0826 83/39
2014/0290166 A1 * 10/2014 Bordener ..... E04F 13/0816 52/474
2016/0230793 A1 * 8/2016 Gulnick ..... E04F 13/083
2017/0204615 A1 * 7/2017 Gulnick ..... F16M 13/02

FOREIGN PATENT DOCUMENTS

GB 2526250 A * 11/2015 ..... E04F 19/0468
JP 1-105859 A 4/1989
JP H02-130929 U 10/1990
JP 4-11844 U 1/1992
JP 4-135643 U 12/1992
JP 5-833 U 1/1993
JP 7-238654 A 9/1995
JP H09-250226 A 9/1997
JP 2002-30782 A 1/2002
JP 2018-162642 A 10/2018
WO WO-2011107581 A1 * 9/2011 ..... E04F 13/083

OTHER PUBLICATIONS

Extended European Serach Report (EESR) dated May 13, 2025 for European Patent Application No. 22825003.1.

* cited by examiner

[Figure1]
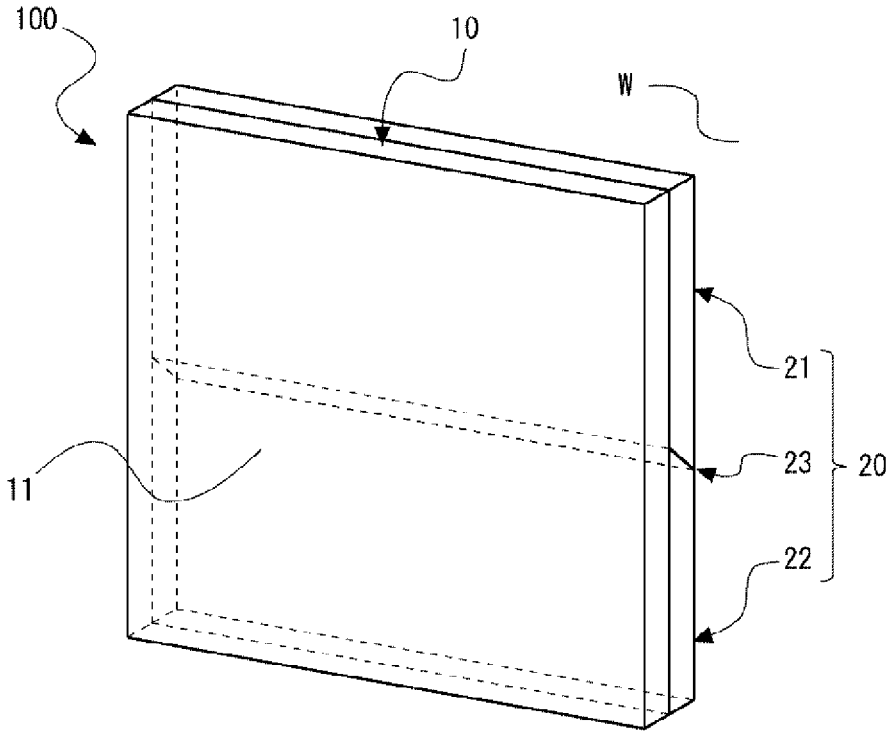

[Figure 2]
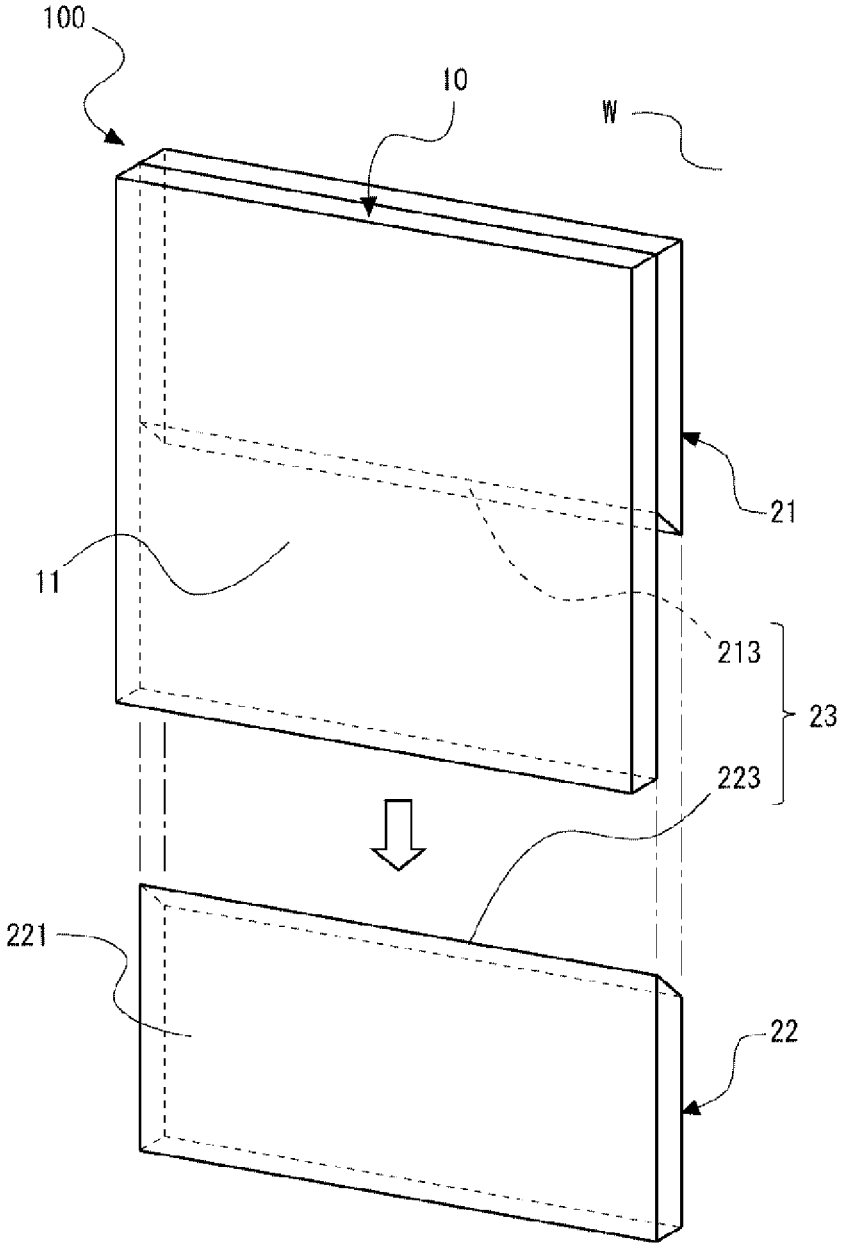

[Figure 3]
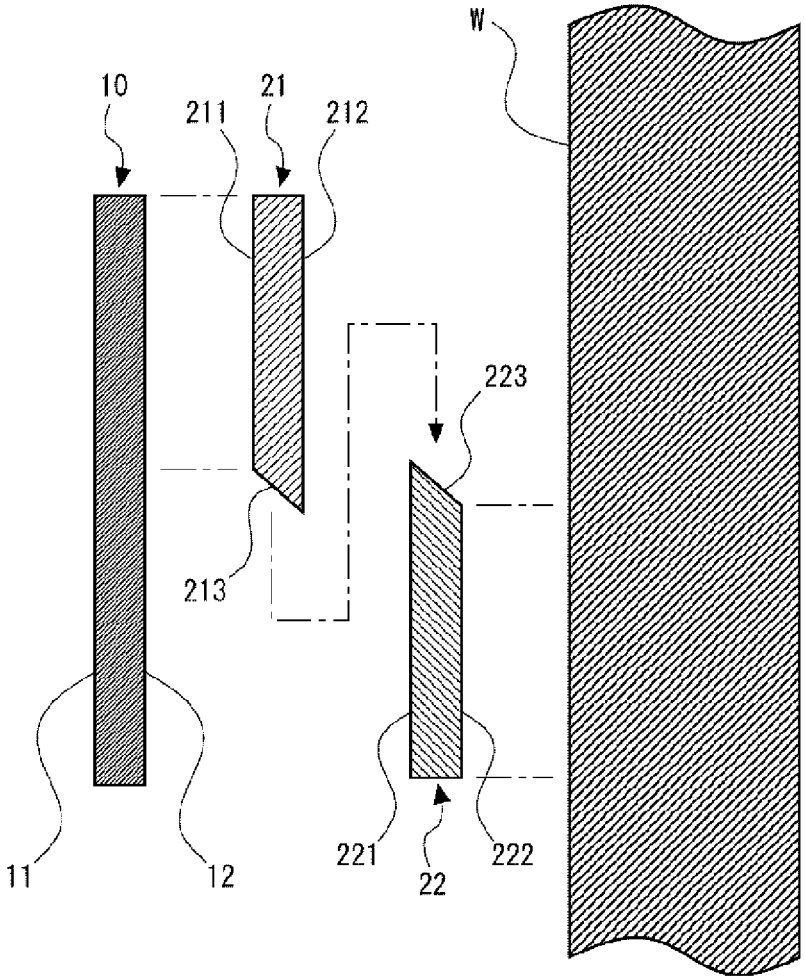

[Figure 4]
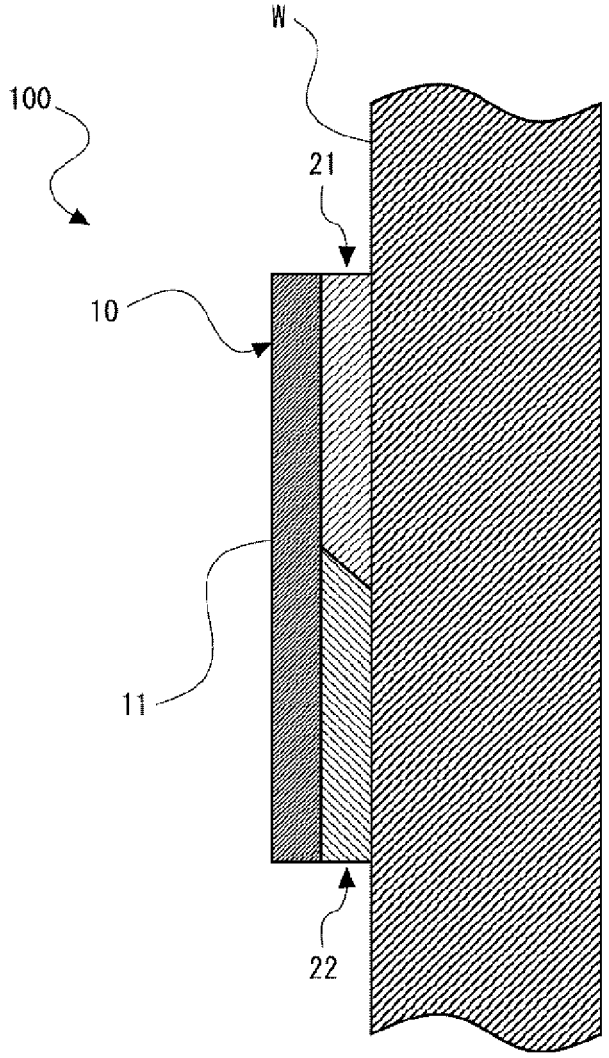

[Figure 5]
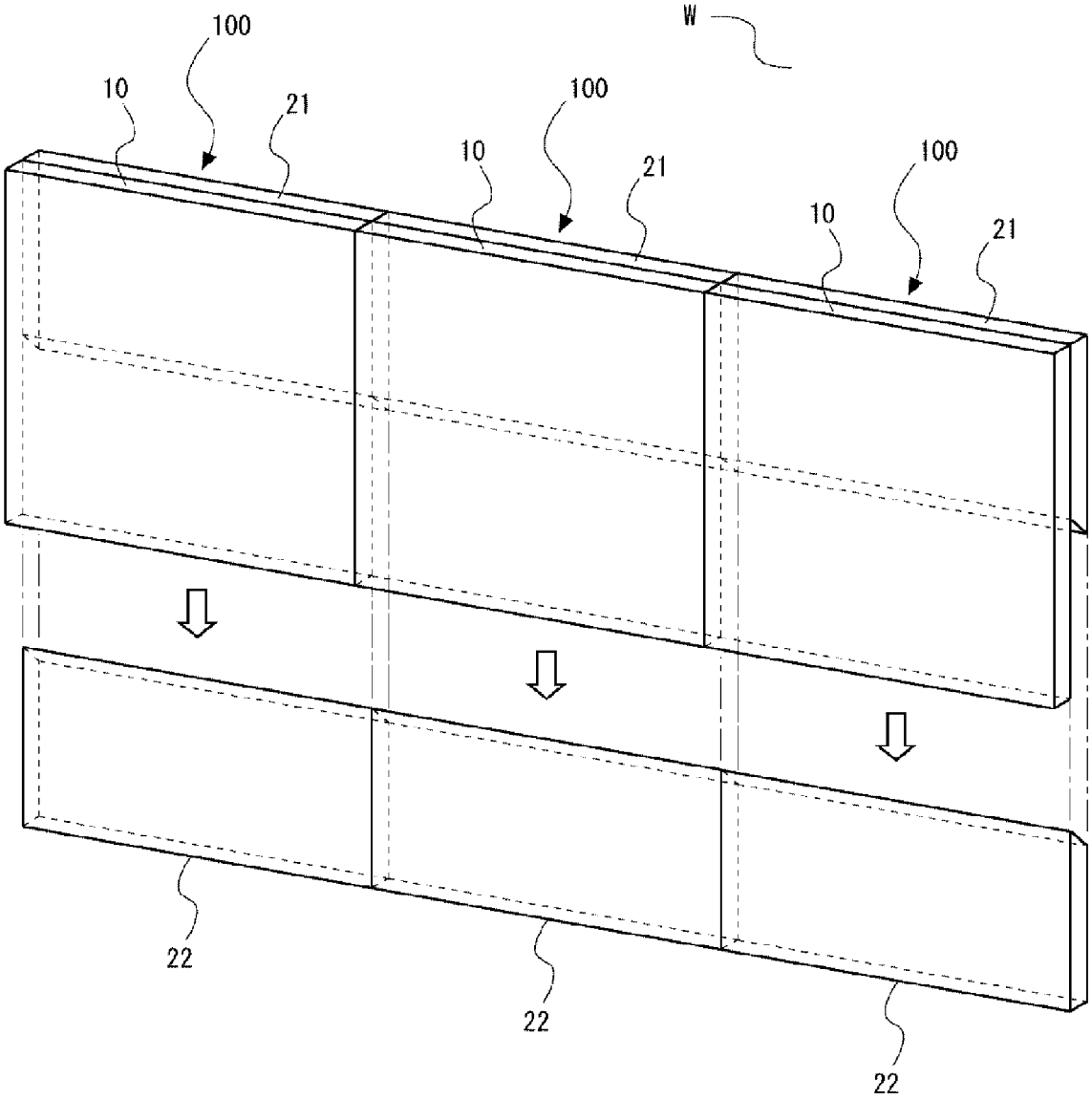

[Figure 6]
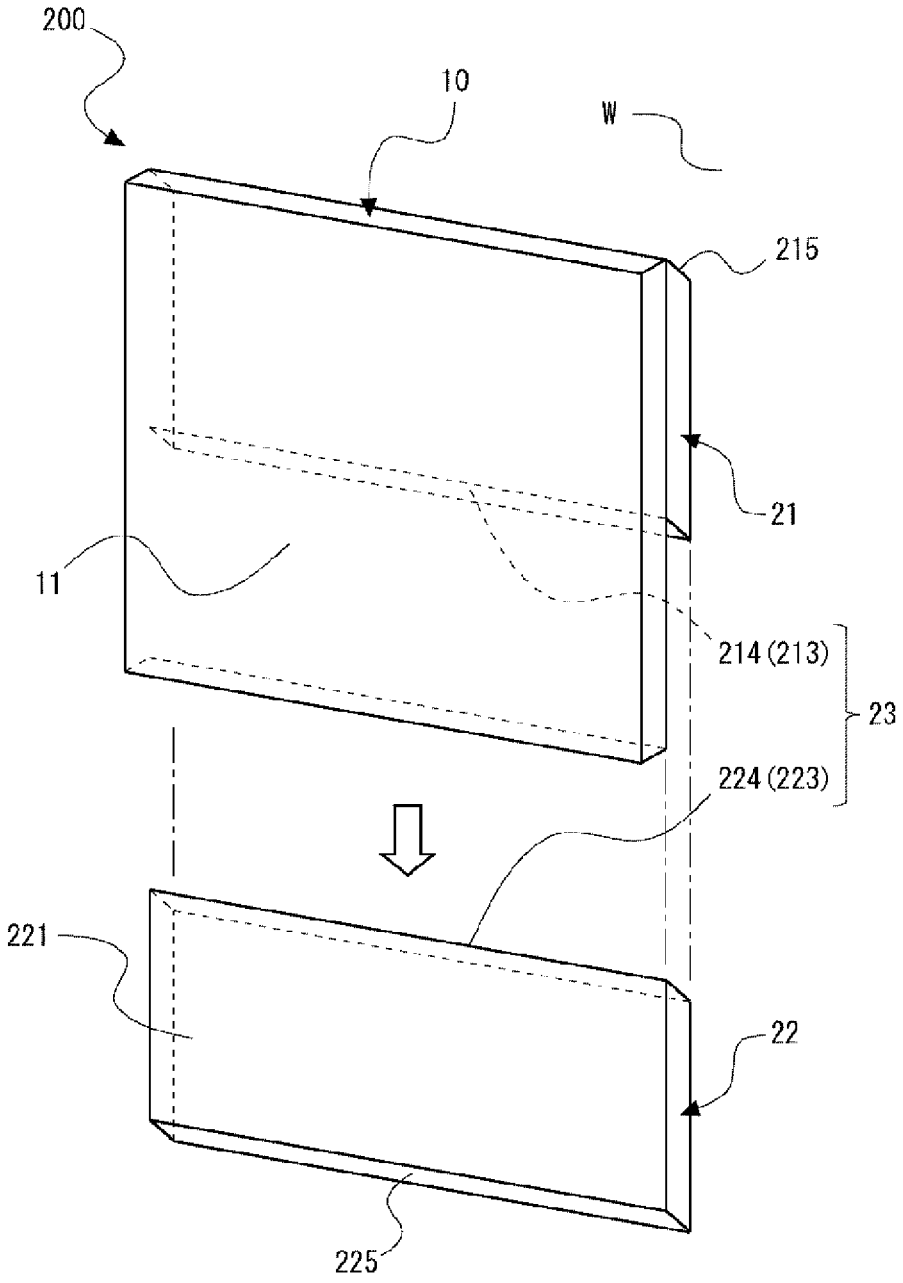

[Figure 7]
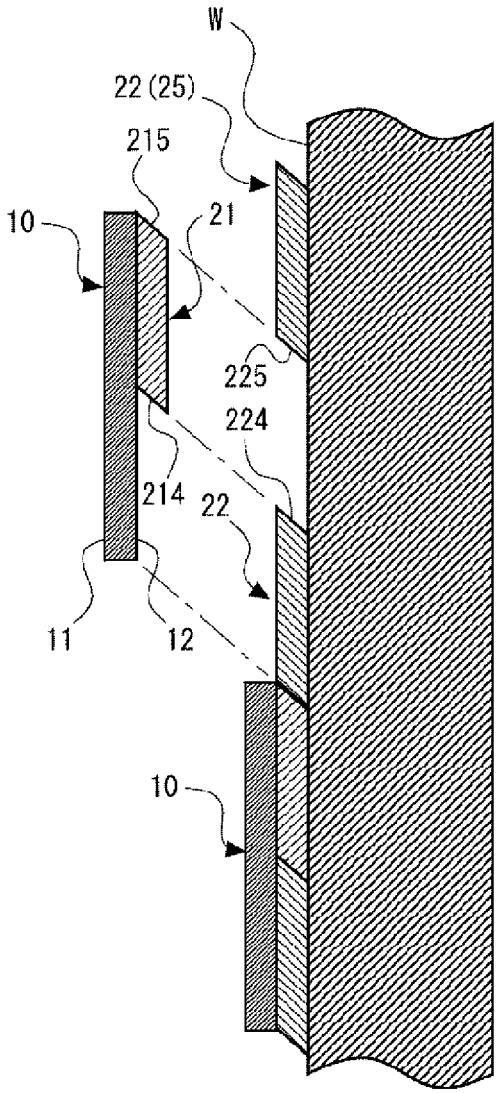

[Figure 8]
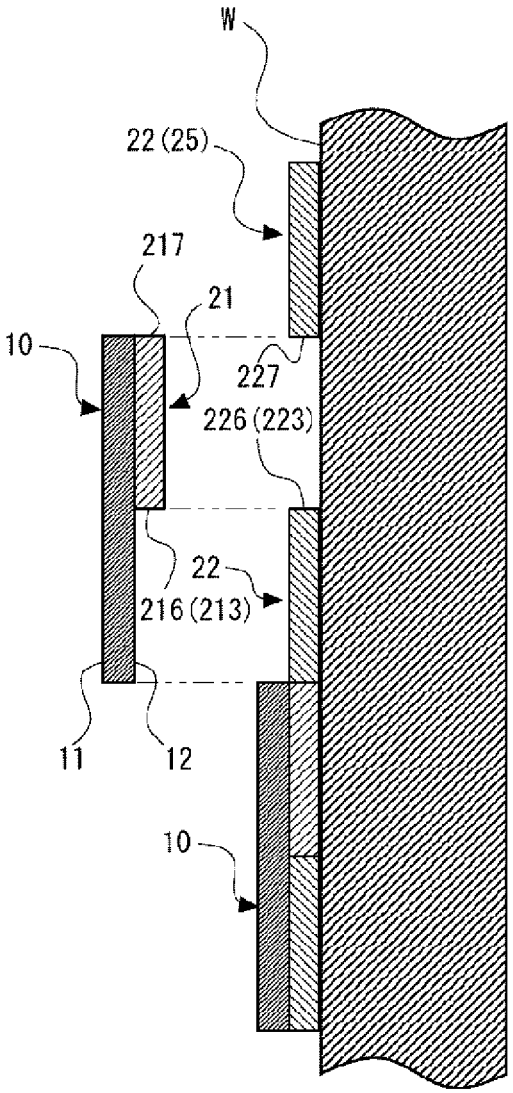

[Figure 9]
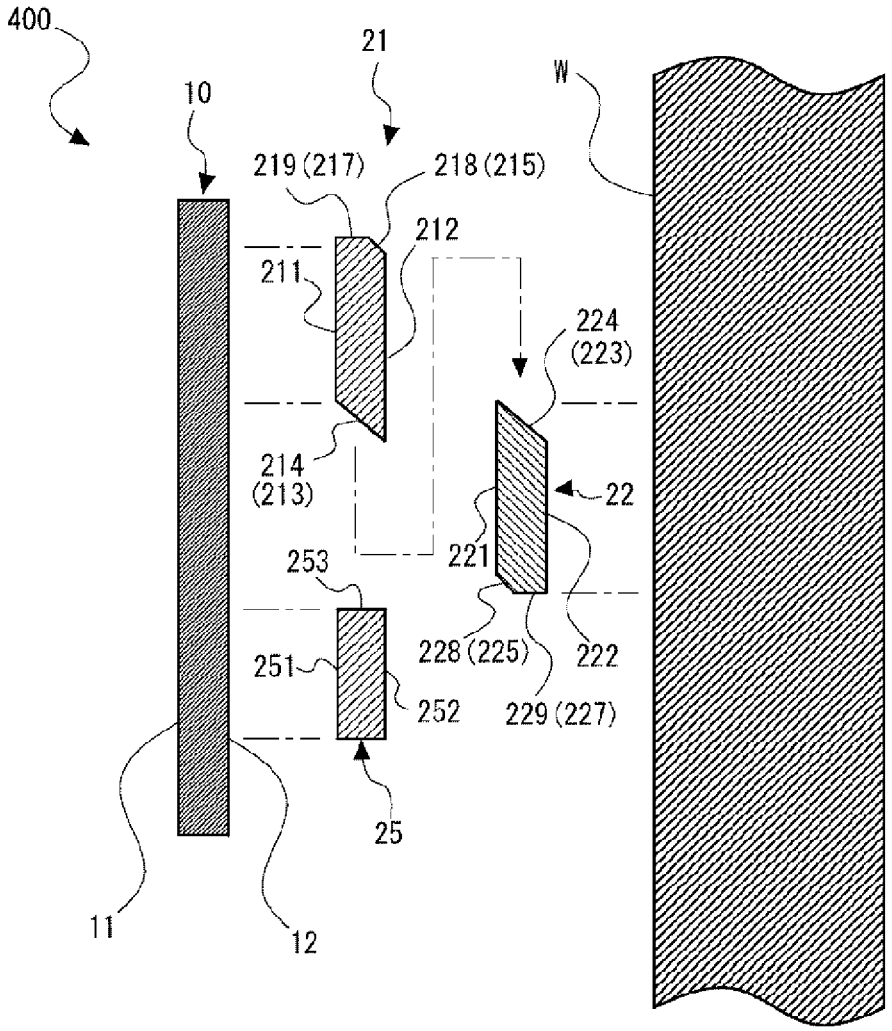

[Figure 10]
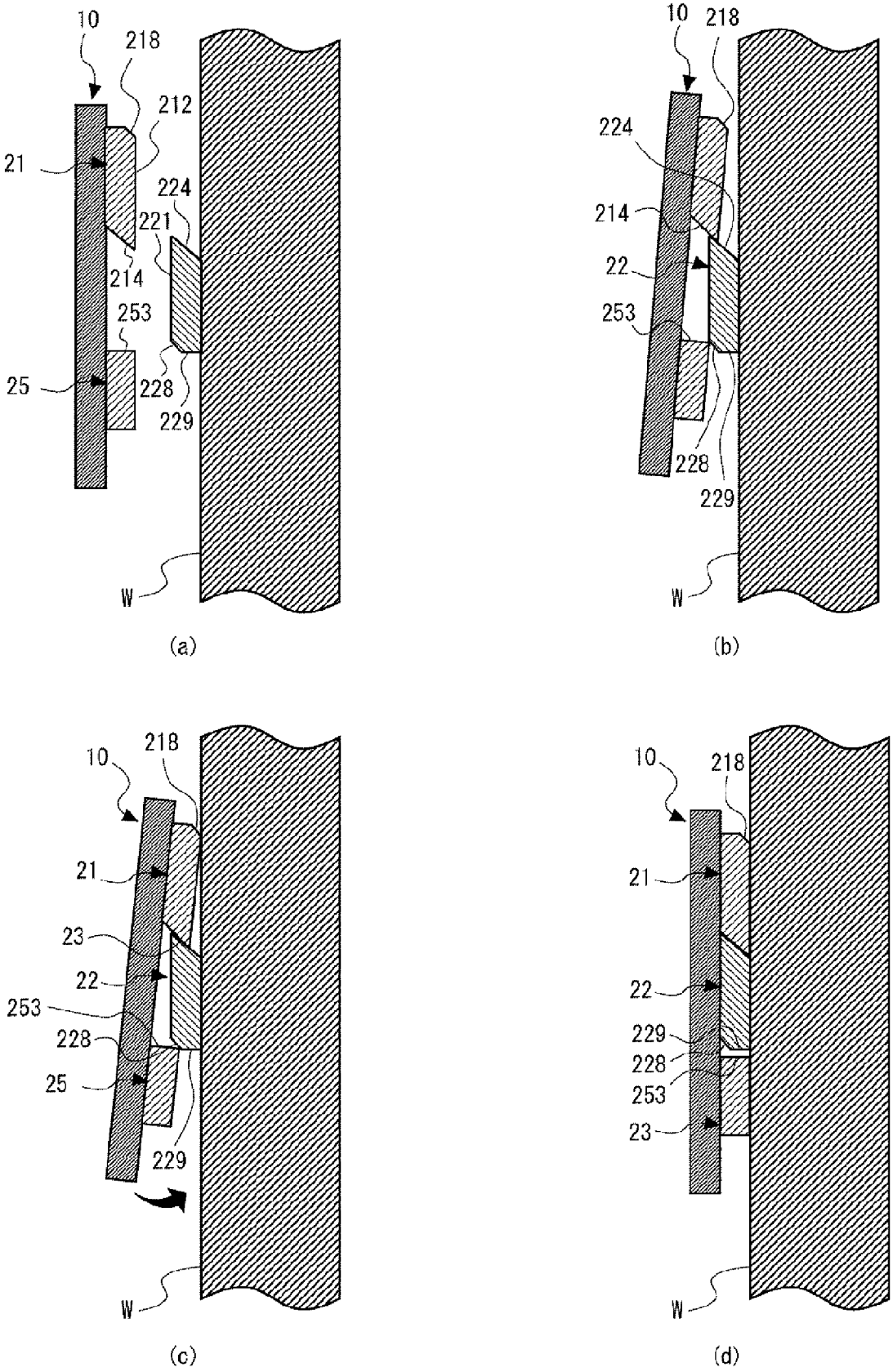

[Figure 11]
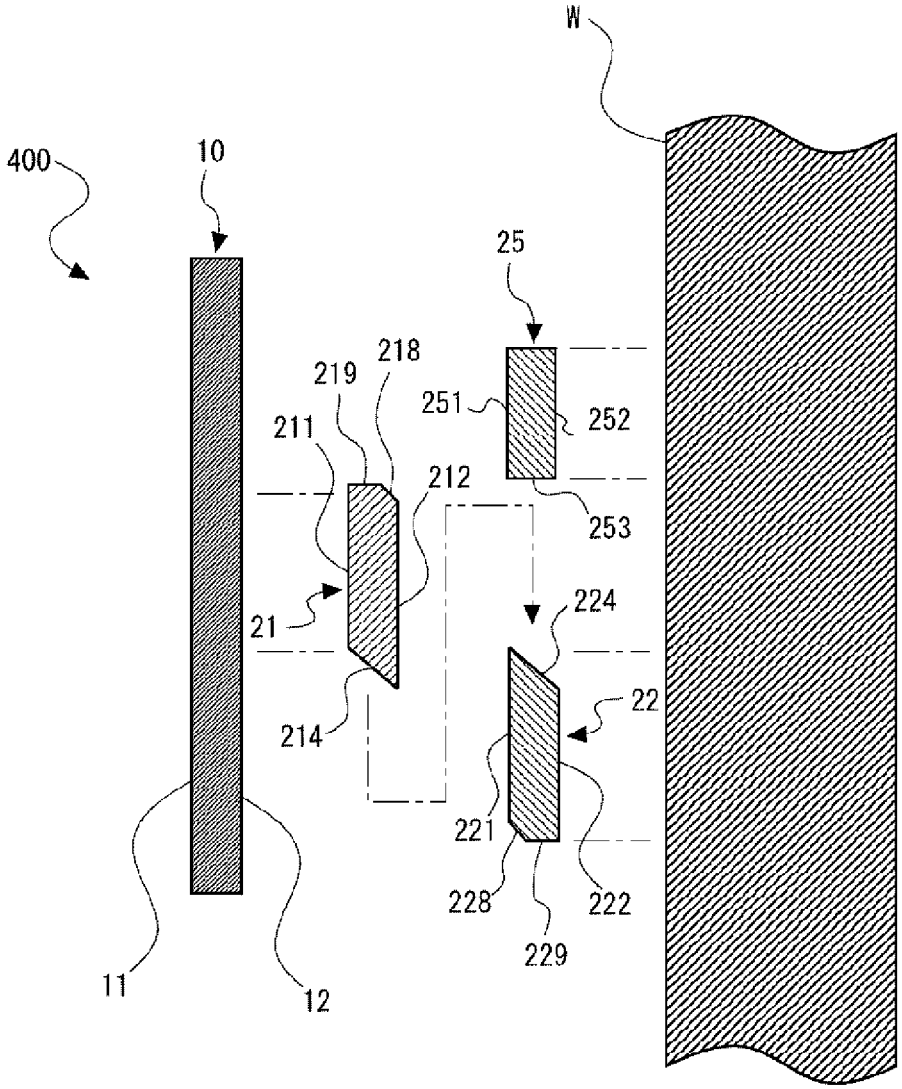

[Figure 12]
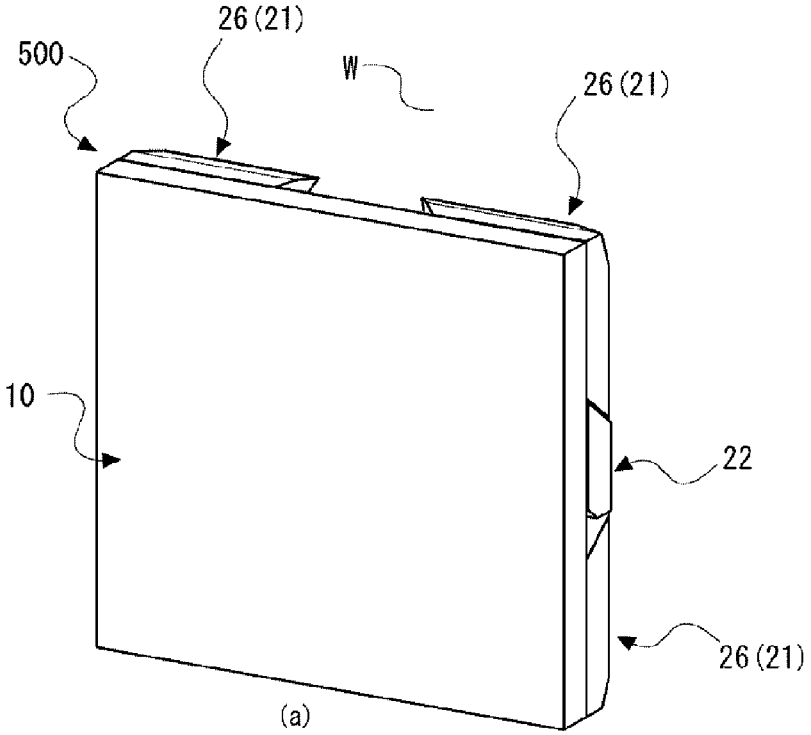
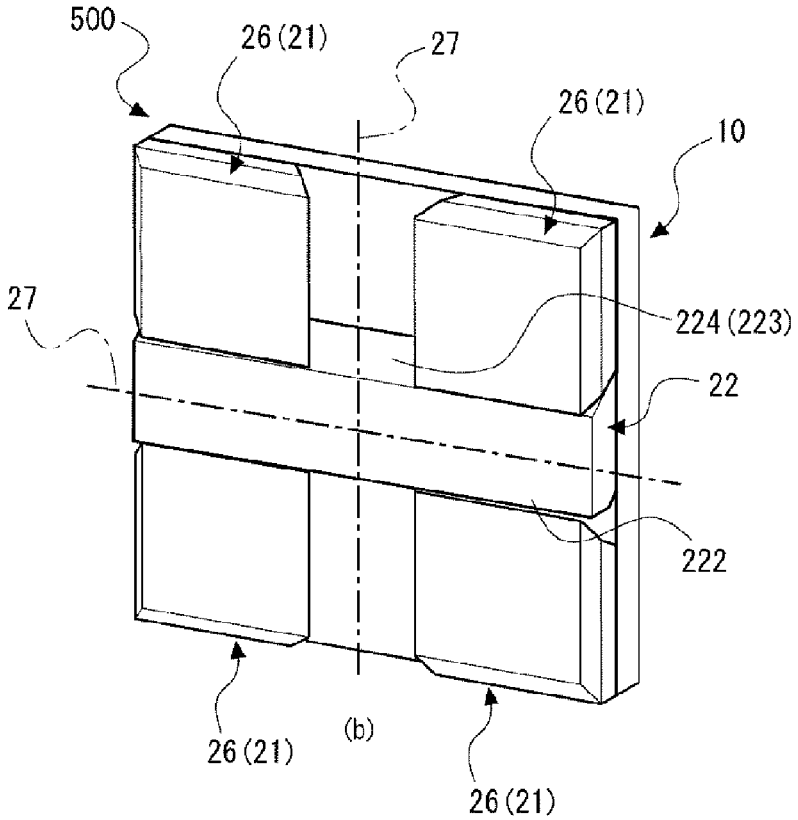

[Figure 13]
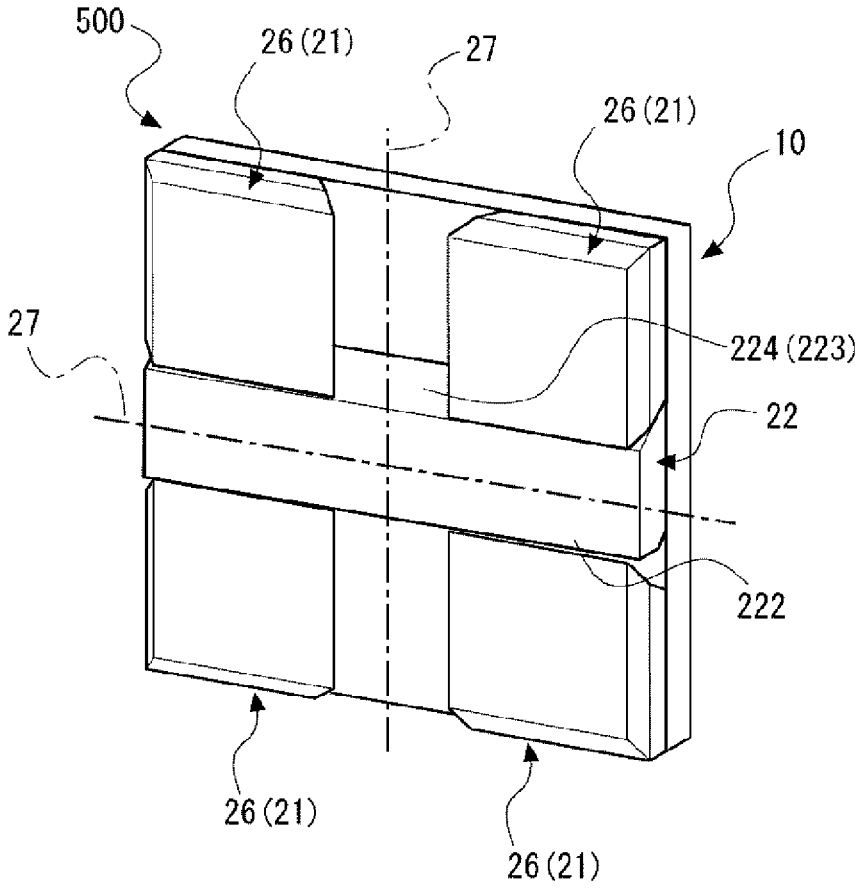

[Figure 14]
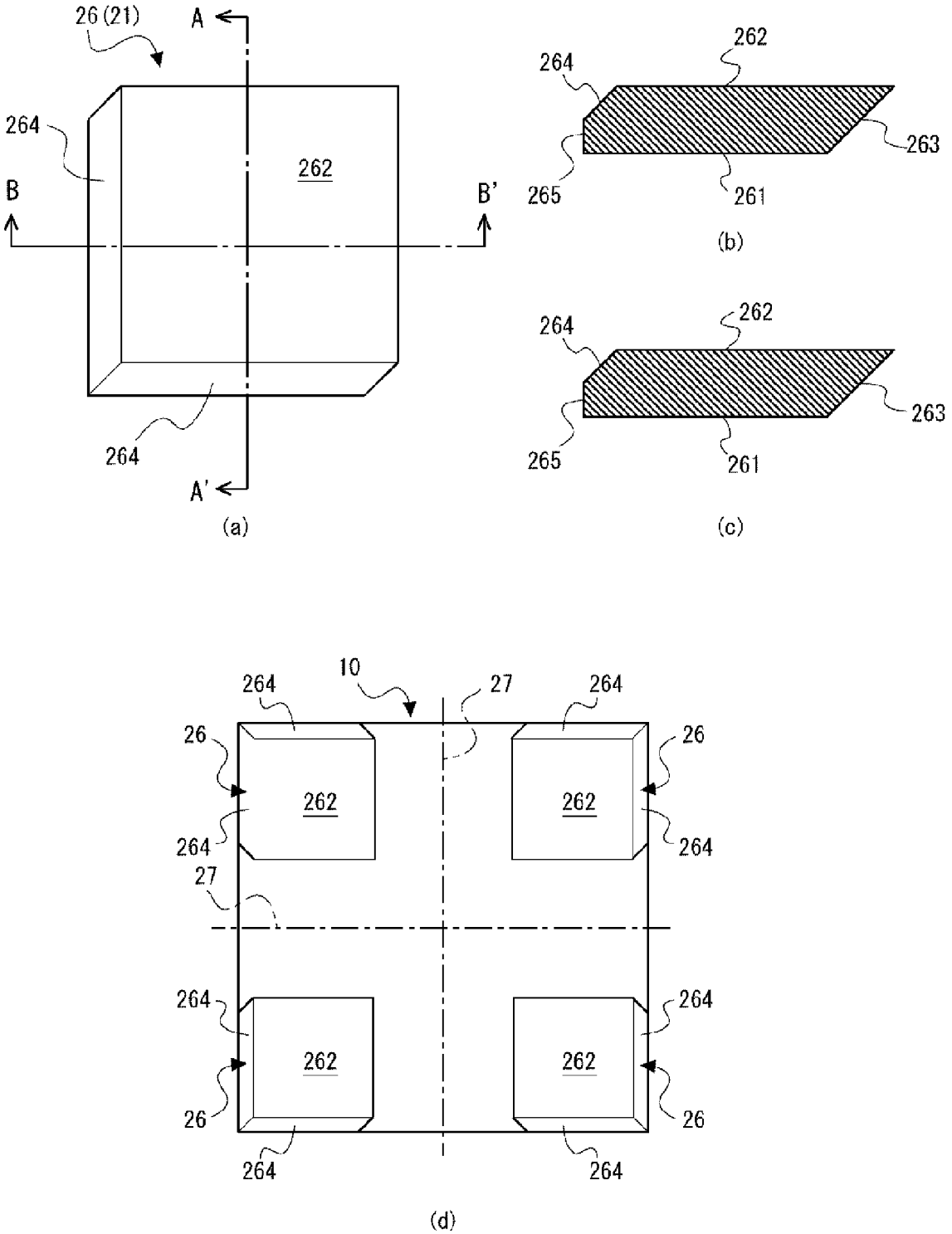

[Figure 15]
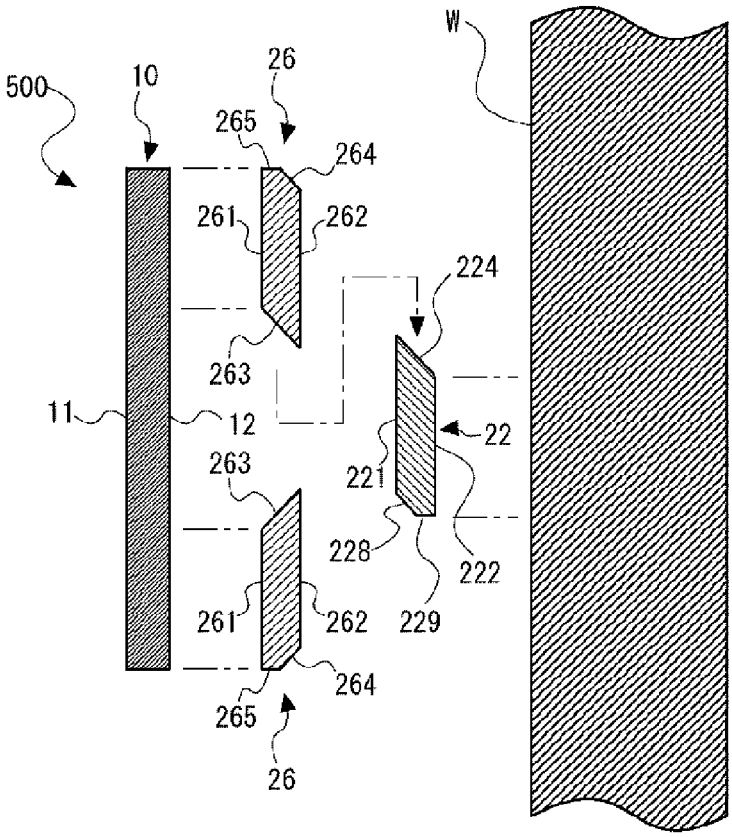
(a)
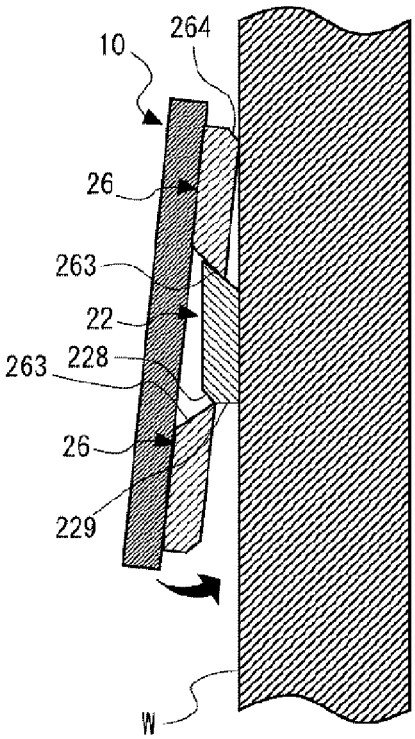
(b)

[Figure 16]
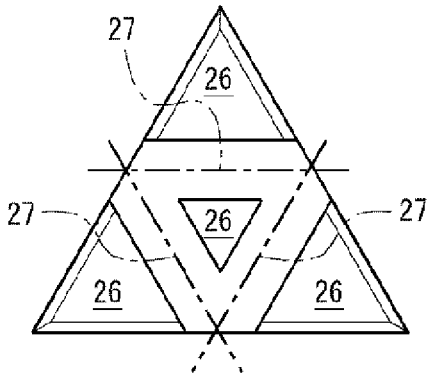
(a)
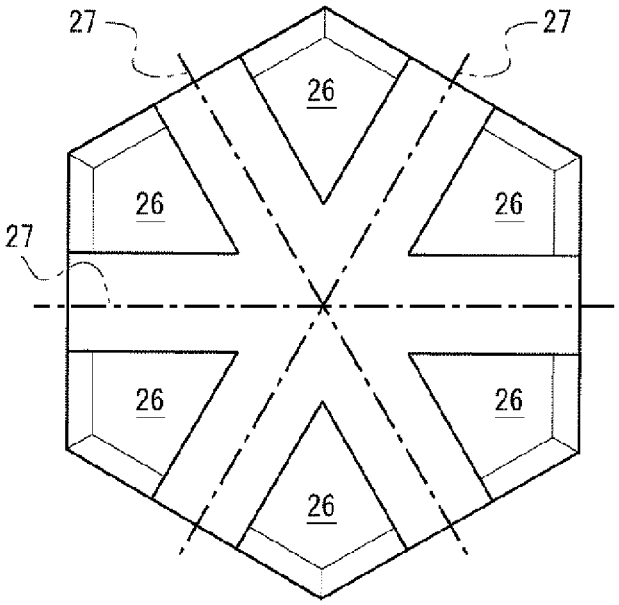
(b)

[Figure 17]
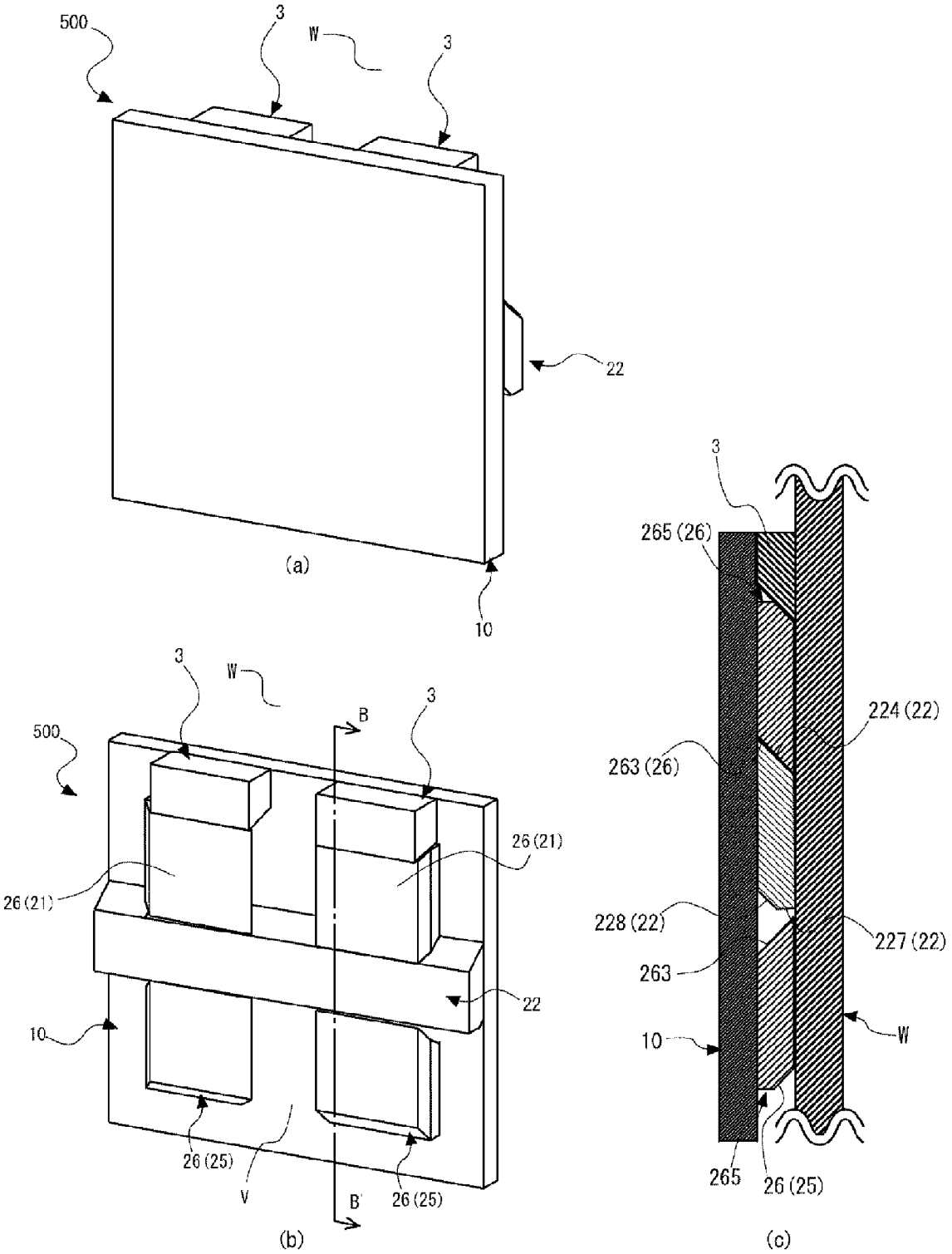

[Figure 18]
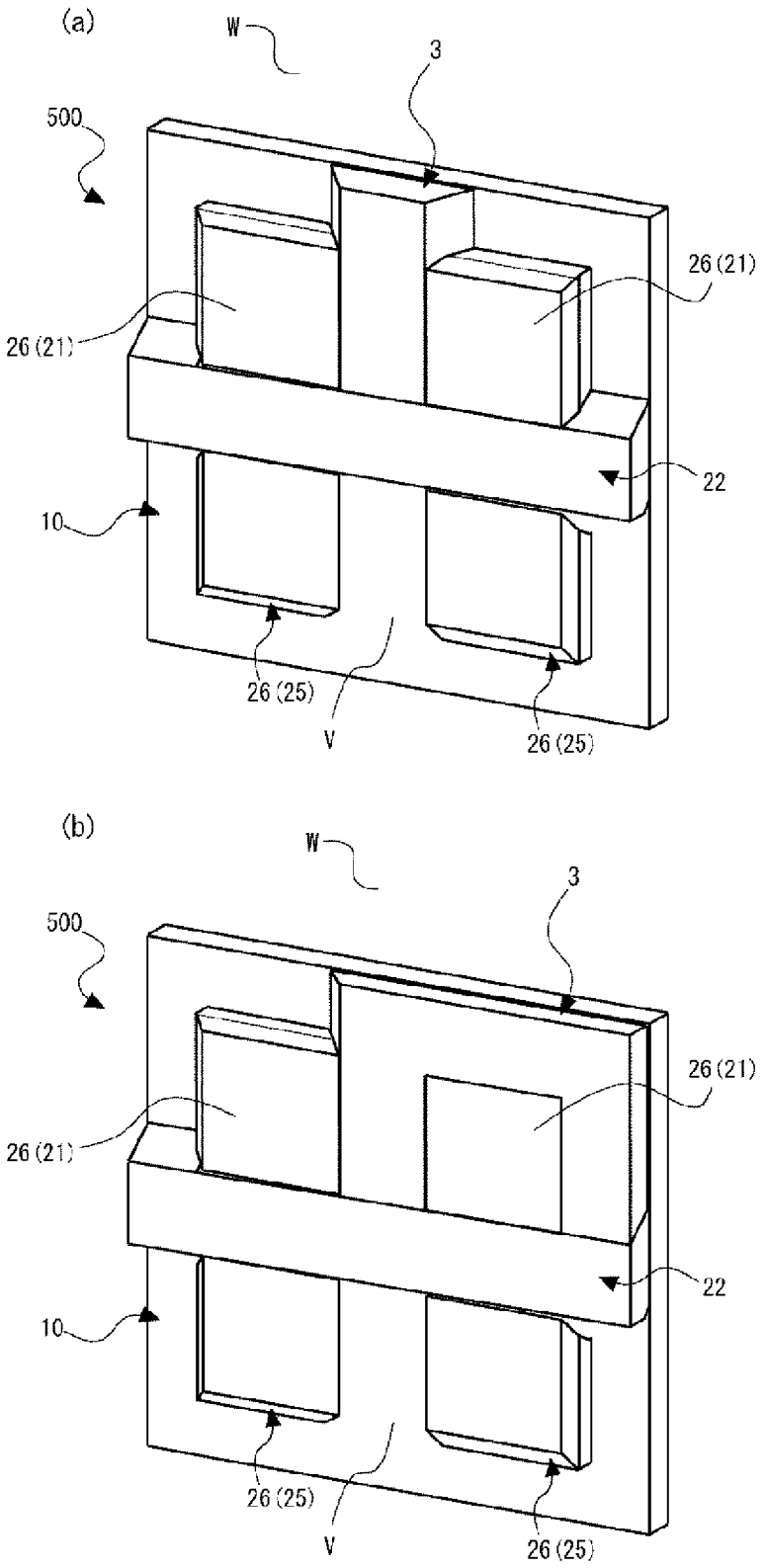

[Figure 19]
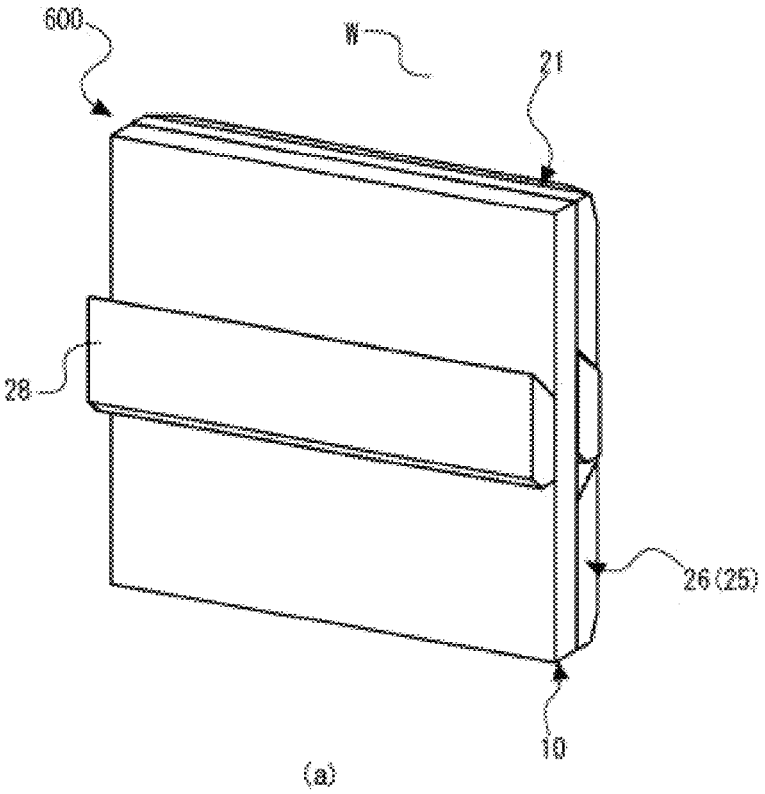
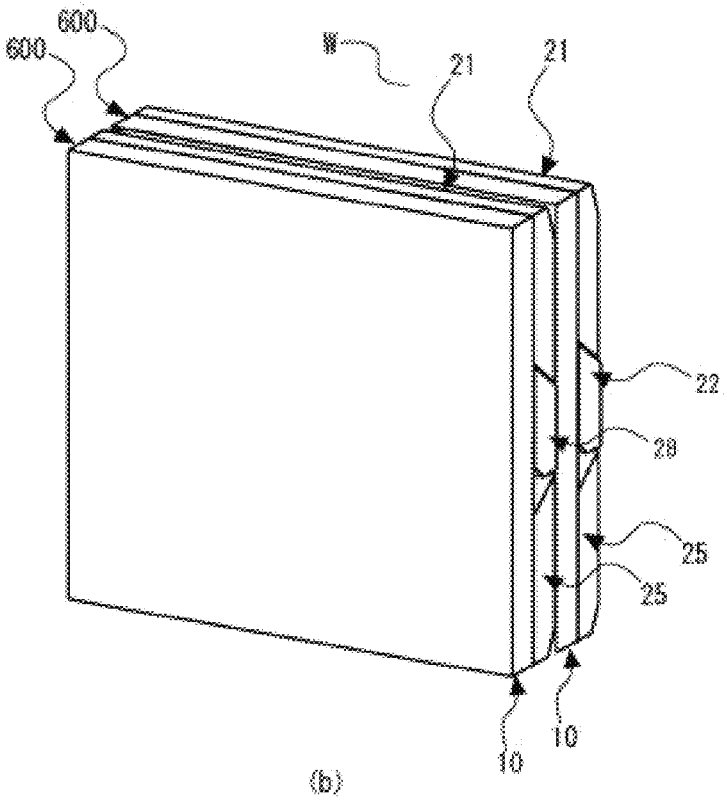

WALL PANEL UNIT AND METHOD FOR INSTALLING WALL PANEL UNIT

TECHNICAL FIELD

The present invention relates to a wall panel unit for installing a panel body on a wall surface, and a method for installing the wall panel unit.

BACKGROUND ART

Conventionally, various techniques have been proposed for easily installing (spreading) wall panels on wall surfaces.

For example, Patent Literature 1 describes a technique of "a clapboard panel obtained by forming a plurality of inclined pieces to protrude from a metal strip at equal intervals, inserting the inclined pieces into longitudinal inclined grooves formed in the middle of each of back surfaces of clapboards, and engaging longitudinal ridges and recesses of the clapboards with each other" for the purpose of simply and quickly spreading the clapboard panel on a wall surface.

CITATION LIST

Patent Literature

Patent Literature 1: JP 2002-30782 A

SUMMARY OF INVENTION

Technical Problem

However, a clapboard panel according to Patent Literature 1 requires processing on a wall panel itself, and is hardly applicable depending on a shape and a material of the wall panel, which is a problem.

In view of the above-described problem, an object to be solved by the present invention is to provide a wall panel unit applicable to various wall panels.

In addition, another object of the present invention is to provide a wall panel unit which allows a wall panel to be easily installed and replaced.

Solution to Problem

The present invention for solving the above-described problem is a wall panel unit including a fixing body capable of fixing a panel body to a wall surface, the fixing body including a first fixing body fixed to the panel body, and a second fixing body fixed to the wall surface and connected to the first fixing body.

In addition, the present invention for solving the above-described problem is a wall panel unit including: a panel body; and a fixing body capable of fixing the panel body to a wall surface, the fixing body including a first fixing body fixed to the panel body, and a second fixing body fixed to the wall surface and connected to the first fixing body.

Since the wall panel unit according to the present invention includes the first fixing body fixed to the panel body and the second fixing body fixed to the wall surface and connected to the first fixing body in this manner, the wall panel unit can be applied to wall panels of various shapes and materials.

In a preferred mode of the present invention, the fixing body includes a support region that supports the entire back surface of the panel body.

Since the fixing body supports the entire back surface of the panel body in this manner, the panel body can be more stably fixed.

In a preferred mode of the present invention, an outer edge portion of the fixing body coincides with an outer edge portion of the panel body.

Since the outer edge portions of the fixing body and the panel body coincide with each other in this manner, a plurality of the fixing bodies and the panel bodies can be arranged. As a result, the wall panels can be installed in a wide region of the wall surface.

In a preferred mode of the present invention, an end surface of the first fixing body on the opposite side of a connection portion is provided with an inclined surface inclined toward the wall surface from the outer side to the inner side of the panel body.

Since the inclined surface is provided on the end surface on the opposite side of a connecting part of the first fixing body in this manner, the panel body can be easily inclined when the first fixing body is connected to the second fixing body.

In a preferred mode of the present invention, a first inclined portion is provided at a connecting part between the first fixing body and the second fixing body, and a second inclined portion inclined at a same angle as the first inclined portion is provided on an opposite side of the connecting part between the first fixing body and the second fixing body.

Since the inclined portions are provided at the connecting part between the first fixing body and the second fixing body and on the opposite side of the connecting part in this manner, the wall panels can be arranged with no gap in the vertical direction.

In a preferred mode of the present invention, the fixing body further includes an auxiliary fixing body, and a notch is provided in an end surface of the first fixing body or an end surface of the second fixing body that is brought close to the auxiliary fixing body.

In a preferred mode of the present invention, the fixing body further includes an auxiliary fixing body, and a notch is provided in an end surface of the auxiliary fixing body.

In a preferred mode of the present invention, the fixing body further includes an auxiliary fixing body, and a parallel surface parallel to an end surface of the auxiliary fixing body is provided on end surface of the first fixing body or an end surface of the second fixing body that is brought close to the auxiliary fixing body.

In a preferred mode of the present invention, the first fixing body includes a plurality of fixing body pieces, and the plurality of fixing body pieces are disposed such that two or more connection grooves connectable to the second fixing body are formed, and the connection grooves intersect each other at a predetermined position. Thus, the panel body can be installed and replaced by rotating an angle thereof.

In a preferred mode of the present invention, the plurality of fixing body pieces are formed in a rectangular shape, and are disposed such that a connection path is formed in a cross shape.

Since the connection grooves are formed in the cross shape in this manner, it is possible to install and replace the panel body by rotating the angle thereof.

In a preferred mode of the present invention, a mounting body to be mounted on the fixing body is provided.

Since the mounting body is provided in this manner, it is possible to generate interference between the panel body and the wall surface when the panel body is inclined, and to prevent unauthorized removal of the panel body.

In a preferred mode of the present invention, the panel body includes a second fixing body connected to the first fixing body on a surface facing a surface on which the first fixing body is provided.

With such a configuration, the panel body can be additionally installed on the panel body, and thus, a height of the panel bodies can be adjusted.

Advantageous Effects of Invention

According to the disclosed technique, the wall panel unit applicable to various wall panels can be provided.

In addition, it is possible to provide the wall panel unit which allows the wall panel to be installed more easily according to the disclosed technique.

Other problems, features and advantages will become apparent from a reading of the following detailed description when taken in conjunction with the drawings and claims.

BRIEF DESCRIPTION OF DRAWINGS

FIG. 1 is an explanatory view illustrating a wall panel unit according to a first embodiment.

FIG. 2 is an explanatory view illustrating the wall panel unit according to the first embodiment.

FIG. 3 is a cross-sectional view of the wall panel unit according to the first embodiment.

FIG. 4 is a cross-sectional view of the wall panel unit according to the first embodiment.

FIG. 5 is an explanatory view illustrating a state in which the wall panel unit according to the first embodiment is used.

FIG. 6 is an explanatory view illustrating a wall panel unit according to a second embodiment.

FIG. 7 is a cross-sectional view of the wall panel unit according to the second embodiment.

FIG. 8 is a cross-sectional view of a wall panel unit according to a third embodiment.

FIG. 9 is a cross-sectional view of a wall panel unit according to a fourth embodiment.

FIG. 10 is an explanatory view illustrating the wall panel unit according to the fourth embodiment.

FIG. 11 is a cross-sectional view of the wall panel unit according to the fourth embodiment.

FIG. 12 is an explanatory view illustrating a wall panel unit according to a fifth embodiment.

FIG. 13 is an explanatory view illustrating the wall panel unit according to the fifth embodiment.

FIG. 14 is an explanatory view illustrating the wall panel unit according to the fifth embodiment.

FIG. 15 is a cross-sectional view of the wall panel unit according to the fifth embodiment.

FIG. 16 is an explanatory view illustrating the wall panel unit according to the fifth embodiment.

FIG. 17 is an explanatory view illustrating a modified example of the wall panel unit according to the fifth embodiment.

FIG. 18 is an explanatory view illustrating a modified example of the wall panel unit according to the fifth embodiment.

FIG. 19 is an explanatory view illustrating a wall panel unit according to a sixth embodiment.

DESCRIPTION OF EMBODIMENTS

Hereinafter, preferred embodiments of a wall panel unit according to the present invention will be described in detail with reference to the accompanying drawings. A technical scope of the present invention is not limited to the embodiments illustrated in the accompanying drawings, and can be appropriately changed within the scope described in the claims. In addition, the accompanying drawings are conceptual diagrams, and relative dimensions and the like of each member do not limit the present invention. In addition, in the present specification, for the purpose of describing the invention, "upper" or "lower" is sometimes referred to on the basis of the upper and lower sides in the drawings, but the upper and lower sides are not limited in relation to the wall panel unit of the present invention. Note that similar configurations will be denoted by the same reference signs in the following description of the embodiments and the accompanying drawings, and redundant description will be omitted.

First Embodiment

FIGS. 1 to 5 are explanatory views illustrating a wall panel unit 100 according to a first embodiment. FIG. 1 is an explanatory view illustrating an appearance of attaching a panel body 10 to a wall surface W. FIG. 2 is an explanatory view illustrating an appearance in which the panel body 10 is attached to the wall surface W. FIG. 3 is a cross-sectional view in a state of attaching the panel body 10 to the wall surface W. FIG. 4 is a cross-sectional view in a state in which the panel body 10 is attached to the wall surface W. FIG. 5 is an explanatory view illustrating an appearance of attaching a plurality of the panel bodies 10 to the wall surface W.

The wall panel unit 100 according to the first embodiment includes a fixing body 20 that is provided between the wall surface W and the panel body 10 and capable of fixing the panel body 10 to the wall surface W.

Note that the wall panel unit 100 according to the present invention may include the panel body 10. That is, the wall panel unit 100 according to the present invention has a mode of including the panel body 10 installed on the wall surface W and the fixing body 20 fixing the panel body 10 to the wall surface W.

Those having a panel shape to be installed on the wall surface W can be adopted as the panel body 10. That is, examples of the panel body 10 include a wood plate, a metal plate, a tile plate, a synthetic resin, wall paper, a plate on which wall paper is pasted, plates on which other wall materials are applied, an advertisement plate, a guide plate, an interior article, an art article, and the like.

In addition, the panel body 10 may be made of a flexible material. Since the panel body 10 itself is deformed, the panel body 10 can be easily attached and detached in a case where the wall panel units 100 are arranged, such as a case in which the panel bodies 10 are disposed on the wall surface W with no gap. The panel body 10 made of the flexible material is, for example, a metal plate.

Any shape that can be used as a wall panel can be adopted although the panel body 10 having a square shape is illustrated in FIGS. 1 to 5. Examples of the shape of the panel body 10 include a square, a rectangle, a trapezoid, a triangle, and other regular polygons.

The fixing body 20 includes a first fixing body 21 fixed to the panel body 10, a second fixing body 22 fixed to the wall surface W and connected to the first fixing body 21, and a connecting part 23 where the first fixing body 21 and the second fixing body 22 are connected.

The first fixing body 21 includes a first support portion 211 which is fixed to the panel body 10 and supports the panel body 10 from a back surface 12 side, an abutment surface 212 which abuts on the wall surface W, and a connection portion 213 connected to the second fixing body 22.

Any means generally used in the construction industry can be adopted as fixing means of the first fixing body 21. That is, examples of the fixing means include an adhesive, screwing with a bolt, a mini-screw, a screw, a nail, a double-sided tape, and the like.

The second fixing body 22 includes a second support portion 221 that abuts on the panel body 10 and supports the panel body 10 from the back surface 12 side, a fixed surface 222 fixed to the wall surface W, and a connection portion 223 connected to the first fixing body 21.

Note that means similar to the fixing means of the first fixing body 21 can be adopted as fixing means of the second fixing body 22.

Any known means can be adopted as the connecting part 23 as long as the second support portion 221 can be connected to abut on the back surface 12 of the panel body 10. Note that FIGS. 1 to 5 regarding the first embodiment illustrate a mode in which the panel body 10 is fixed to the wall surface W by forming inclined surfaces of the first fixing body 21 and the second fixing body 22, respectively, and locking these inclined surfaces to each other. As other means, for example, means for fitting using a recess and a protrusion, or means for fitting by sliding from the lateral direction of the second fixing body 22 can be adopted.

In addition, the fixing body 20 desirably has a support region 24 that supports the entire back surface 12 of the panel body 10. The support region 24 is a region including the first support portion 211 and the second support portion 221.

Since the entire back surface 12 of the panel body 10 is supported by the support region 24 of the fixing body 20 in this manner, it is possible to enhance the stability when the panel body 10 is installed on the wall surface W.

In addition, an outer edge portion of the fixing body 20 desirably coincides with an outer edge portion of the panel body 10. That is, the back surface 12 of the panel body 10 and the support region 24 desirably coincide with each other in a state in which the first fixing body 21 and the second fixing body 22 are connected.

Since the outer edge portions of the fixing body 20 and the panel body 10 coincide with each other in this manner, the plurality of panel bodies 10 can be arranged with no gap as illustrated in FIG. 5.

In addition, the first fixing body 21 and the second fixing body 22 desirably have the same shape.

Since first fixing body and second fixing body have the same shape in this manner, it is not necessary to manufacture the first fixing body 21 and the second fixing body 22 in different steps, and manufacturing cost can be reduced.

According to the present invention, the panel body 10 is fixed to the wall surface W by connecting the first fixing body 21 fixed to the panel body 10 and the second fixing body 22 fixed to the wall surface W. Therefore, it is possible to install the panel body 10 regardless of a shape and a material, and a variety of the panel bodies 10 can be installed on the wall surface W.

Second Embodiment

Hereinafter, a wall panel unit 200 according to a second embodiment will be described in detail with reference to FIG. 6 or 7. The second embodiment includes the fixing body 20 having a shape different from that of the above embodiment. Note that components of this embodiment which are basically the same as those in the above embodiment will be denoted by the same reference signs, and description thereof will be simplified.

As illustrated in FIG. 6, the wall panel unit 200 according to the second embodiment includes the fixing body 20 provided between the wall surface W and the panel body 10 and capable of fixing the panel body 10 to the wall surface W. In addition, the fixing body 20 includes the first fixing body 21 fixed to the panel body 10 and the second fixing body 22 fixed to the wall surface W and connected to the first fixing body 21.

Note that the wall panel unit 200 may include the panel body 10. That is, the wall panel unit 100 according to the present invention has a mode of including the panel body 10 installed on the wall surface W and the fixing body 20 fixing the panel body 10 to the wall surface W.

The first fixing body 21 according to the second embodiment includes the first support portion 211 which is fixed to the panel body 10 and supports the panel body 10 from the back surface 12 side, the abutment surface 212 that abuts on the wall surface W, a first inclined portion 214 (corresponding to the connection portion 213 of the above embodiment) connected to the second fixing body 22, and a second inclined portion 215 provided on the opposite side of the first inclined portion 214 and inclined at an angle similar to that of the first inclined portion 214.

The second fixing body 22 according to the second embodiment includes the second support portion 221 that abuts on the panel body 10 and supports the panel body 10 from the back surface 12 side, the fixed surface 222 fixed to the wall surface W, a first inclined portion 224 (corresponding to the connection portion 223 of the above embodiment) connected to the first fixing body 21, and a second inclined portion 225 provided on the opposite side of the first inclined portion 224 and inclined at an angle similar to that of the first inclined portion 224.

That is, according to the present embodiment, the first inclined portion 214 or 224 is provided in connecting part 23 between the first fixing body 21 and the second fixing body 22, and the second inclined portion 215 or 225 inclined at the similar angle with the first inclined portion 214 or 224 is provided on the opposite side of the connecting part 23 between the first fixing body 21 and the second fixing body 22.

FIG. 7 is an explanatory view illustrating an appearance of installing the wall panel unit 200 according to the present embodiment on the wall surface W.

Since the second inclined portions 215 and 225 inclined at the similar angle with the first inclined portions 214 and 224 in this manner, the first fixing body 21 can be connected to the second fixing body 22 along the inclination angle. As a result, the wall panels can be arranged with no gap in the vertical direction.

Third Embodiment

Hereinafter, a wall panel unit 300 according to a third embodiment will be described in detail with reference to FIG. 8. The third embodiment includes the fixing body 20 having a shape different from that of the above embodiments. Note that components of this embodiment which are basically the same as those in the above embodiment will be denoted by the same reference signs, and description thereof will be simplified.

As illustrated in FIG. 8, the wall panel unit 300 according to the third embodiment includes the fixing body 20 provided between the wall surface W and the panel body 10 and capable of fixing the panel body 10 to the wall surface W. In addition, the fixing body 20 includes the first fixing body 21 fixed to the panel body 10 and the second fixing body 22 fixed to the wall surface W and connected to the first fixing body 21.

Note that the wall panel unit 300 may include the panel body 10. That is, the wall panel unit 100 according to the present invention has a mode of including the panel body 10 installed on the wall surface W and the fixing body 20 fixing the panel body 10 to the wall surface W.

The first fixing body 21 according to the third embodiment includes the first support portion 211 which is fixed to the panel body 10 and supports the panel body 10 from the back surface 12 side, the abutment surface 212 that abuts on the wall surface W, a first horizontal portion 216 (corresponding to the connection portion 213 of the above embodiment) connected to the second fixing body 22, and a second horizontal portion 217 provided on the opposite side of the first horizontal portion 216.

The second fixing body 22 according to the third embodiment includes the second support portion 221 that abuts on the panel body 10 and supports the panel body 10 from the back surface 12 side, the fixed surface 222 fixed to the wall surface W, a first horizontal portion 226 (corresponding to the connection portion 223 of the above embodiment) connected to the first fixing body 21, and a second horizontal portion 227 provided on the opposite side of the first horizontal portion 226.

That is, according to the present embodiment, the first horizontal portion 216 or 226 is provided in the connecting part 23 between the first fixing body 21 and the second fixing body 22, and the second horizontal portion 217 or 227 is provided on the opposite side of connecting part 23 between the first fixing body 21 and the second fixing body 22.

According to the present embodiment, the connecting part 23 between the first fixing body 21 and the second fixing body 22 is formed horizontally. In this manner, the connecting part 23 is formed horizontally, and thus, can be fitted perpendicularly to the wall surface as illustrated in FIG. 8.

This is useful, for example, in a temporary use scene such as a wall of a booth of an exhibition, a studio, or a set of a stage in a case where convenience in attachment and detachment is required rather than safety. In addition, the panel body 10 can be easily disposed on the entire surface of the wall surface W.

Fourth Embodiment

Hereinafter, a wall panel unit 400 according to a fourth embodiment will be described in detail with reference to FIGS. 9 to 11. The fourth embodiment includes an auxiliary fixing body 25 in addition to the first fixing body 21 and the second fixing body 22. Note that components of this embodiment which are basically the same as those in the above embodiment will be denoted by the same reference signs, and description thereof will be simplified.

FIG. 9 is an explanatory view illustrating a configuration of the wall panel unit 400 according to the fourth embodiment. FIG. 9 illustrates a mode in which the auxiliary fixing body 25 is installed on the panel body 10 side.

The wall panel unit 400 according to the fourth embodiment includes the fixing body 20 provided between the wall surface W and the panel body 10 and capable of fixing the panel body 10 to the wall surface W, which is similar to the above embodiments. The fixing body 20 includes the first fixing body 21 fixed to the panel body 10, the second fixing body 22 fixed to the wall surface W and connected to the first fixing body 21, and the auxiliary fixing body 25 that assists the connection between the first fixing body 21 and the second fixing body 22.

The first fixing body 21 includes, on an end surface on the opposite side of the connecting part 23, an inclined surface 218 (corresponding to the second inclined portion 215 of the third embodiment) inclined toward the wall surface W from the outer side to the inner side of the panel body 10, and a parallel surface 219 (corresponding to the second horizontal portion 217 of the third embodiment) parallel to an end surface of the auxiliary fixing body 25 to be described later.

The second fixing body 22 includes, on an end surface on the opposite side of the connecting part 23, an inclined surface 228 (corresponding to the second inclined portion 225 of the third embodiment) inclined toward the panel body 10 from the outer side to the inner side of the panel body 10 and a parallel surface 229 (corresponding to the horizontal portion 237 of the third embodiment) parallel to an end surface 253 of the auxiliary fixing body 25 to be described later.

The auxiliary fixing body 25 includes a support portion 251 which is fixed to the panel body 10 and supports the panel body 10 from the back surface 12 side, an abutment surface 252 which abuts on the wall surface W, and the end surface 253 which is brought close to the second fixing body 22 (or the first fixing body 21).

FIG. 10 is an explanatory view illustrating an appearance of installing the panel body 10 of the fourth embodiment on the wall surface W. FIG. 10(*a*) is an explanatory view illustrating a state in which the first fixing body 21 and the second fixing body 22 are separated. As illustrated in FIG. 10(*a*), a minimum interval between the first fixing body 21 and the auxiliary fixing body 25 is shorter than a maximum vertical length of the second fixing body 22. This prevents attachment and detachment of the panel body 10 in a state in which the panel body 10 is parallel to the wall surface W. Note that the minimum interval between the first fixing body 21 and the auxiliary fixing body 25 is an interval from a distal end of the first inclined portion 214 of the first fixing body 21 to the end surface 253 of the auxiliary fixing body 25. Note that the maximum vertical length of the second fixing body 22 is a sum of a vertical length of the second support portion 221 and a vertical length of the inclined surface 228.

FIG. 10(*b*) is an explanatory view illustrating a state of the panel body 10 at the initial stage of connection. In this state at the initial stage of connection, the upper end side of the panel body 10 is inclined toward the wall surface W, and the first inclined portion 214 of the first fixing body 21 is brought into contact with the first inclined portion 224 of the second fixing body 22. A length from the distal end of the first inclined portion 214 of the first fixing body 21 to the end surface 253 of the auxiliary fixing body 25 is configured to be substantially equal to or slightly longer than the vertical length of the second support portion 221 of the second fixing body 22. As a result, the end surface 253 of the auxiliary fixing body 25 can be brought close to the wall surface W from the inclined surface 228 of the second fixing body 22 by hooking the distal end of the first inclined portion 214 of the first fixing body 21 on a distal end of the first inclined portion 224 of the second fixing body 22.

FIG. 10(*c*) is an explanatory view illustrating a state of the panel body 10 at the later stage of connection. In this state at the later stage, the second fixing body 22 enters between the first fixing body 21 and the auxiliary fixing body 25 by changing the inclination angle of the panel body 10 such that the lower end side of the panel body 10 is brought close to the wall surface W while being slid along the inclination of the first inclined portion 214 or 224. At this time, since the inclined surface 218 of the first fixing body 21 is provided, the first fixing body 21 can be brought close to the wall surface W side, and the first fixing body 21 and the second fixing body 22 can be connected.

Here, the inclined surface 228 and a corner of the auxiliary fixing body 25 come into contact with each other when the first fixing body 21 and the wall surface W come into contact with each other.

FIG. 10(*d*) is an explanatory view illustrating a state in which the first fixing body 21 and the second fixing body 22 are connected. In this connected state, the end surface 253 of the auxiliary fixing body 25 and the parallel surface 229 formed on the end surface of the second fixing body 22 face each other, thereby obtaining a state in which the connection is not easily released. That is, in order to remove the panel body 10, it is necessary to slide the panel body 10 along the inclination of the first inclined portion 224 of the second fixing body 22 while changing the inclination angle of the panel body 10 so as to move the lower end side of the panel body 10 away from the wall surface W.

In addition, in the connected state, the inclined surface 218 of the first fixing body 21 is provided so as to have a gap from the wall surface W, and the inclined surface 228 of the second fixing body 22 is provided so as to have a gap from the panel body 10.

According to the present embodiment, since the auxiliary fixing body 25 is further provided, it is possible to restrict a movement range (movement route) in attachment and detachment of the panel body 10 and to suppress the connection between the panel body 10 and the wall surface W from being easily released. In other words, the panel body 10 is attached to the wall surface W by being inclined while being slid in the order of FIGS. 10(*a*), 10(*b*), 10(*c*), and 10(*d*), and the panel body 10 is removed from the wall surface W by being inclined in the order of FIGS. 10(*d*), 10(*c*), 10(*b*), and 10(*a*). Note that the panel body 10 can also be removed by being slid in the width direction of the first fixing body 21. In this manner, it is possible to suppress the panel body 10 from falling due to an earthquake or being removed by a malicious third party by configuring the panel body 10 to be taken off only along a specific movement route when the panel body 10 is attached and detached.

FIG. 11 exemplifies a mode in which the auxiliary fixing body 25 of the present embodiment is disposed on the wall surface W side. As illustrated in FIG. 11, the mode in which the auxiliary fixing body 25 is disposed on the wall surface W side also has effects similar to those of the mode in which the auxiliary fixing body 25 is disposed on the panel body 10. That is, since the parallel surface 219 of the first fixing body 21 faces the end surface 253 of the auxiliary fixing body 25, a movement route of the panel body 10 can be restricted.

Note that FIGS. 10 and 11 illustrate an example in which a notch is provided in the first fixing body 21, but the notch may be provided in the auxiliary fixing body 25, or the notch may be provided in both the first fixing body 21 and the auxiliary fixing body 25. That is, the auxiliary fixing body 25 can be smoothly inserted by providing the notch in the end surface of the auxiliary fixing body 25.

Fifth Embodiment

Hereinafter, a wall panel unit 500 according to a fifth embodiment will be described in detail with reference to FIGS. 12 to 17. In the fifth embodiment, the first fixing body 21 includes a plurality of fixing body pieces 26. Note that components of this embodiment which are basically the same as those in the above embodiment will be denoted by the same reference signs, and description thereof will be simplified.

FIGS. 12 to 17 are explanatory views illustrating the wall panel unit 500 according to the fifth embodiment and modified examples thereof. FIG. 12(*a*) is a perspective view of a state in which the wall panel unit 500 according to the fifth embodiment is attached to the wall surface W as viewed from the front side. FIG. 12(*b*) is a perspective view of a state in which the wall panel unit 500 according to the fifth embodiment is attached to the wall surface W as viewed from the back side. FIG. 13 is an explanatory view illustrating a configuration of the wall panel unit 500 according to the fifth embodiment.

The wall panel unit 500 according to the fifth embodiment includes the fixing body 20 provided between the wall surface W and the panel body 10 and capable of fixing the panel body 10 to the wall surface W, which is similar to the above embodiments. The fixing body 20 includes the first fixing body 21 fixed to the panel body 10 and the second fixing body 22 fixed to the wall surface W and connected to the first fixing body 21.

The first fixing body 21 includes a plurality of fixing body pieces 26, and the plurality of fixing body pieces 26 are disposed so as to form two or more connection grooves 27 that can be connected to the second fixing body 22. That is, as an example of the wall panel unit 500 according to the fifth embodiment, two rectangular fixing body pieces 26 are disposed in each of the vertical direction and the left-right direction of the panel body 10 (four in total) in accordance with corners of the panel body, so that two connection grooves 27 are formed in a cross shape as illustrated in FIGS. 12 to 15.

Here, the second fixing body 22 is attached to the plurality of fixing body pieces 26 by being provided to be longer than a length of one side of the fixing body piece 26.

A thickness of the fixing body piece 26 in the present embodiment is assumed to be 8 mm to 15 mm, and a distance between a size of the panel body 10 and an outer edge of the fixing body piece 26 is assumed to be 70 mm to 90 mm on one side, but is preferably 100 mm or more. In addition, widths of the connection groove 27 and the second fixing body 22 are preferably 40 mm or more. As a result, a gap generated between the first fixing body 21 and the second fixing body 22 can be made smaller than the entire size, and rattling can be reduced.

FIG. 14 is an explanatory view illustrating the fixing body piece 26. FIG. 14(*a*) is a plan view of one fixing body piece 26. FIG. 14(*b*) is a cross-sectional view taken along line A-A' of FIG. 14(*a*). FIG. 14(*c*) is a cross-sectional view taken along line B-B' of FIG. 14(*a*). FIG. 14(*d*) is a back view illustrating a state in which the fixing body piece 26 is disposed on the panel body 10.

The fixing body piece 26 is a solid piece formed in a parallelepiped shape, and includes a first support portion 261 that is fixed to the panel body 10 and supports the panel body 10 from the back surface 12 side, an abutment surface 262 that abuts on the wall surface W, a connection portion 263 connected to the second fixing body 22, an inclined surface 264 inclined from the outer side to the inner side of the panel body 10, and a flat surface 265 perpendicular to the wall surface W.

The inclined surface 264 can prevent interference between the fixing body piece 26 and the wall surface W when the panel body 10 is inclined, which is similar to the inclined surface 218 in the fourth embodiment. Therefore, the panel body 10 can be attached to the wall surface W by sliding and inclining the panel body 10, which is similar to the fourth embodiment.

The fixing body piece 26 is disposed on the panel body 10 such that the connection portions 263 face each other.

As a result, as illustrated in FIG. 15, the fixing body piece 26 located above the second fixing body 22 functions as the first fixing body 21, and the fixing body piece 26 located below the second fixing body 22 can be fitted as the auxiliary fixing body 25 similarly as in the fourth embodiment.

In particular, it is preferable to form the inclined surface 228 and an upper end of the lower fixing body piece 26 to come into contact with each other when the upper fixing body piece 26 and the wall surface W come into contact with each other.

The connection grooves 27 can be formed by disposing the plurality of fixing body pieces 26 at intervals in the panel body 10. Although the configuration in which the two connection grooves 27 are disposed in a cross shape is exemplified in FIGS. 12 to 14, three or more connection grooves 27 may be formed as illustrated in FIG. 15. FIG. 16(*a*) illustrates an example in which the three connection grooves 27 are formed in a triangular shape by disposing the fixing body pieces 26 each having a triangular shape in the panel body 10 at intervals. FIG. 16(*b*) illustrates an example in which the three connection grooves 27 are formed in an asterisk shape by disposing the fixing body pieces 26 each having a diamond shape on the panel body 10 at intervals.

In addition, as illustrated in FIG. 17, the wall panel unit 500 may be configured such that a distance is provided between a side surface end of the panel body 10 and the fixing body piece 26, and a mounting body 3 mounted on the upper portion of the fixing body piece 26.

The mounting body 3 is a solid piece provided independently of the panel body 10 so as to have substantially the same thickness as the thickness of the fixing body piece 26, and the mounting body 3 is provided with an inclination such that a lower surface thereof abuts on the inclined surface 264 as illustrated in FIG. 17(*c*). Note that the lower surface may be provided horizontally so as to be mounted on the flat surface 265. In addition, the mounting body 3 is provided to have substantially the same height as the distance from an upper end of the abutment surface 262 to the side surface of the panel body 10, and thus, is not visually recognizable in a front view as illustrated in FIGS. 17(*a*) and 17(*b*).

A user can mount the panel body 10 on the fixing body piece 26 by installing the panel body 10 on the wall surface W and then inserting the mounting body 3 into a gap between the panel body 10 and the wall surface W. As a result, the mounting body 3 interferes when an attempt is made to incline the panel body 10, so that malicious removal can be suppressed.

In addition, a width of the mounting body 3 is provided to be substantially the same as a width of the fixing body piece 26 in FIG. 17, but the width is preferably larger than at least the width of the connection groove 27, and may be expanded to be substantially the same as a width of the panel body 10.

In addition, as illustrated in FIG. 18(*a*), the mounting body 3 may have a cross section in the same shape as the second fixing body 22, and the lower surface in a shape corresponding to the second fixing body 22. As a result, the mounting body 3 can penetrate into the connection groove 27 to be mounted on the second fixing body 22, and thus, the stability thereof is enhanced.

Further, as illustrated in FIG. 18(*b*), the mounting body 3 may be formed in a U shape to surround the fixing body piece 26 from three directions and be mounted on the second fixing body 22 and the fixing body piece 26, thereby further enhancing the stability.

Note that the height of the mounting body 3 is preferably larger than the distance from the upper end of the abutment surface 262 to the side surface of the panel body 10 in a case where the panel bodies 10 are provided vertically adjacent to each other. With such a configuration, the inclination is suppressed by the interference of the mounting body 3 mounted on the fixing body piece 26 in the upper portion of the panel body 10. Further, the inclination is suppressed by the interference of the mounting body 3 protruding from the adjacent panel body 10 in the lower portion of the panel body 10. Thus, the inclination does not occur in any direction in the vertical direction, and the malicious removal can be suppressed.

According to the present embodiment, an angle at which the panel body 10 is attached and detached can be changed by forming two or more connection grooves 27. That is, in a case where the two connection grooves 27 are formed in a cross shape, the panel body 10 can be rotated by 90 degrees each time and fixed to the wall surface W. In addition, when the connection grooves 27 are formed in the triangular shape in FIG. 15(*a*) or the asterisk shape in FIG. 15(*b*), the panel body 10 can be rotated by 60 degrees each time and fixed to the wall surface W. When an orientation of the panel body 10 is changed in this manner, the design of the wall panel can be variously changed and enjoyed.

Sixth Embodiment

Hereinafter, a wall panel unit 600 according to a sixth embodiment will be described in detail with reference to FIG. 18. As illustrated in FIG. 19(*a*), in the sixth embodiment, a fixing body 28 on a front surface connected to the first fixing body is provided on a surface of the panel body 10 facing a surface on which the first fixing body 21 is provided in addition to the configuration of the fourth embodiment. Note that components of this embodiment which are basically the same as those in the above embodiment will be denoted by the same reference signs, and description thereof will be simplified.

The fixing body 28 on the front surface is a fixing body having substantially the same shape as the second fixing body 22. The fixing body 28 is pasted or attached to the front surface of the panel body 10 so as to be parallel to the second fixing body 22 at substantially the same height as the second fixing body 22 in the state of being attached to the wall surface W.

As illustrated in FIG. 19(*b*), another panel body 10 can be attached to the front surface of the panel body 10 by the fixing body 28 on the front surface, and a height of the panel bodies 10 to be installed can be freely adjusted. That is, the unevenness can be expressed, and the application to various wall panels is possible.

In addition, although not illustrated, a plurality of projections may be provided on an upper surface and/or a lower surface of the second fixing body 22 in the above first to sixth embodiments at an interval wider than at least the first fixing body 21 or the fixing body piece 26. As a result, removal due to sliding of the panel body 10 in the width direction can be prevented, and attachment strength can be improved. It is assumed to form the projections by driving a nail, attaching a metal fitting, or the like.

A thickness of the fixing body 20 in the above first to sixth embodiments can be 10 mm or less. In particular, since the entire surface of the panel body 10 is supported in the first to third embodiments, the stable support can be achieved even when the thickness is 3 mm to 7 mm.

REFERENCE SIGNS LIST

100, 200, 300, 400, 500, 600 wall panel unit
10 panel body
11 front surface
12 back surface
20 fixing body
21 first fixing body
211 first support portion
212 abutment surface
213 connection portion
214 first inclined portion
215 second inclined portion
22 second fixing body
221 second support portion
222 fixed surface
223 connection portion
224 first inclined portion
225 second inclined portion
23 connecting part
24 support region
25 auxiliary fixing body
26 fixing body piece
27 connection groove
28 fixing body on front surface
W wall surface
S space

The invention claimed is:

1. A wall panel unit comprising
a fixing body capable of fixing a panel body to a wall surface,
wherein the fixing body includes a first fixing body fixed to the panel body, and a second fixing body fixed to the wall surface and connected to the first fixing body,
the first fixing body includes a plurality of fixing body pieces,
the plurality of fixing body pieces are formed in a rectangular shape and disposed to form two or more connection grooves connectable to the second fixing body,
the connection grooves intersect each other at a predetermined position and are disposed to be formed in a cross shape, and
the connection grooves are formed by the plurality of fixing body pieces of the same shape provided on a back surface of the panel body, and have cross-sectional shapes that are mutually congruent.

2. The wall panel unit according to claim 1, wherein the fixing body includes a support region that supports an entirety of the back surface of the panel body.

3. The wall panel unit according to claim 1, wherein an outer edge portion of the fixing body coincides with an outer edge portion of the panel body.

4. The wall panel unit according to claim 1, wherein an end surface of the first fixing body on an opposite side of a connection portion is provided with an inclined surface inclined toward the wall surface from an outer side to an inner side of the panel body.

5. The wall panel unit according to claim 1, wherein
a first inclined portion is provided at a connecting part between the first fixing body and the second fixing body, and
a second inclined portion inclined at a same angle as the first inclined portion is provided on an opposite side of the connecting part between the first fixing body and the second fixing body.

6. The wall panel unit according to claim 1, wherein
the fixing body further includes an auxiliary fixing body, and
a notch is provided in an end surface of the first fixing body or an end surface of the second fixing body that is brought close to the auxiliary fixing body.

7. The wall panel unit according to claim 1, wherein
the fixing body further includes an auxiliary fixing body, and
a notch is provided in an end surface of the auxiliary fixing body.

8. The wall panel unit according to claim 1, wherein
the fixing body further includes an auxiliary fixing body, and
a parallel surface parallel to an end surface of the auxiliary fixing body is provided on end surface of the first fixing body or an end surface of the second fixing body that is brought close to the auxiliary fixing body.

9. The wall panel unit according to claim 1, further comprising a mounting body placed on an upper portion of the plurality of fixing body pieces.

10. The wall panel unit according to claim 1, wherein the panel body includes a front surface fixing body connected to the first fixing body, on a front surface opposite to the back surface of the panel body.

* * * * *